United States Patent [19]

Taylor et al.

[11] Patent Number: 4,773,164

[45] Date of Patent: Sep. 27, 1988

[54] SELF-ALIGNING CALIBER BAR

[75] Inventors: Douglas P. Taylor, North Tonawanda, N.Y.; David A. Lee, Santa Monica, Calif.; John J. Frost, Kraainem, Belgium

[73] Assignee: Tayco Developments, Inc., North Tonawanda, N.Y.

[21] Appl. No.: 59,069

[22] Filed: Jun. 8, 1987

[51] Int. Cl.[4] ..... G01C 21/00

[52] U.S. Cl. ..... 33/520; 33/234; 33/286; 33/533; 33/644; 356/153

[58] Field of Search ..... 33/178 F, 234, 245, 33/286, 299, 520, 543, 644, 533; 356/153; 279/1 L, 2 R, 2 A

[56] References Cited

U.S. PATENT DOCUMENTS

| | | | |
|---|---|---|---|
| 1,805,343 | 5/1931 | Robbins | 33/178 |
| 2,353,272 | 7/1944 | Simmons et al. | 88/1 |
| 2,638,681 | 5/1953 | Kinley et al. | 33/174 |
| 2,766,533 | 10/1956 | Brandon | 33/178 F |
| 2,773,309 | 12/1956 | Elliott | 33/46 |
| 2,819,527 | 1/1958 | Spurling | 33/234 |
| 2,860,415 | 11/1958 | Danilow | 33/520 |
| 3,612,949 | 10/1971 | Becraft et al. | 33/286 |
| 3,641,678 | 2/1972 | Murphey, Jr. et al. | 33/174 |
| 3,744,133 | 7/1973 | Fukushima et al. | 33/234 |
| 3,782,740 | 1/1974 | Peyrot | 279/2 R |
| 4,057,905 | 11/1977 | Piaja | 33/234 |
| 4,090,305 | 5/1978 | Cassidy | 33/234 |
| 4,136,956 | 1/1979 | Eichweber | 356/153 |
| 4,459,757 | 7/1984 | Lippuner et al. | 33/234 |
| 4,534,116 | 8/1985 | Davis | 33/234 |

FOREIGN PATENT DOCUMENTS

| | | | |
|---|---|---|---|
| 647136 | 6/1937 | Fed. Rep. of Germany | 33/234 |

*Primary Examiner*—William D. Martin, Jr.
*Attorney, Agent, or Firm*—Joseph P. Gastel

[57] ABSTRACT

A caliber bar for locating the centerline of the bore at the muzzle of a gun including a frame, first and second trunnion housings axially mounted on the frame, each of the trunnion housings pivotally mounting three centering arms circumferentially spaced at 120° from each other for contacting the side of a bore at axially spaced locations, and first and second liquid springs mounted on the first and second trunnion housings, respectively, for biasing the centering arms associated with each trunnion housing simultaneously outwardly equal amounts into engagement with the side of the bore, and detents for removably holding the first and second trunnion housings in the frame.

20 Claims, 2 Drawing Sheets

SELF-ALIGNING CALIBER BAR

BACKGROUND OF THE INVENTION

The present invention relates to an improved caliber bar for determining the longitudinal centerline of the bore at the muzzle end of a gun.

By way of background, after a gun or rifle has been fired a number of times, the bore at the muzzle end of a gun may be distorted so that its centerline no longer coincides with the alignment of the sights associated therewith. In the case of small caliber weapons capable of being carried by a person, several test rounds are fired at a target and the sights are adjusted to coincide with the line of fire. In the case of larger caliber weapons, various mechanical and/or optical devices have been developed for determining the centerline of the bore at the muzzle end of the gun. Some of these devices determine the bore centerline by direct measurement, others use indirect measuring means often determining a line parallel but not coaxial with the gun bore centerline. Devices, such as shown in U.S. Pat. No. 4,459,757, did not determine the centerline with accuracy within a short enough time period to be of use in the field.

SUMMARY OF THE INVENTION

It is accordingly one object of the present invention to provide an improved caliber bar for accurately determining the centerline of a muzzle bore, even though it may have been distorted in different ways, such as by belling out or by being off center in other respects.

Another object of the present invention is to provide an improved caliber bar which can be operated by unspecialized personnel in the field with high accuracy and reliability.

Still another object of the present invention is to provide a caliber bar which inherently can be used to find the centerline of bores of various diameters without requiring any adjustment or replacement of parts whatsoever.

A further object of the present invention is to provide an improved caliber bar utilizing liquid springs which will force centering arms against the sides of the bore with sufficient pressure to maintain the caliber bar firmly in place during the alignment procedure.

Still another object of the present invention is to provide an improved caliber bar utilizing liquid springs for biasing centering arms, the liquid springs being capable of providing high spring forces in the relatively small area in which the caliber bar is used. Other objects and attendant advantages of the present invention will readily be perceived hereafter.

The present invention relates to a caliber bar for locating the centerline of the bore at the muzzle of a gun comprising a frame having a longitudinal axis, a first series of first arms spaced circumferentially from each other and movably mounted on said frame, a second series of second arms spaced circumferentially from each other and movably mounted on said frame, said first series of first arms being axially spaced from said second series of second arms, and biasing means for simultaneously biasing said first arms outwardly equal amounts from said longitudinal axis of said frame for engaging the side of said bore at a first location and for simultaneously biasing said second arms outwardly equal amounts from said longitudinal axis of said frame for engaging the side of said bore at a second location which is axially spaced from said first location to thereby cause said longitudinal axis of said frame to coincide with said centerline of said bore at the muzzle of said gun.

The various aspects of the present invention will be more fully understood when the following portions of the specification are read in conjunction with the accompanying drawings wherein:

DESCRIPTION OF THE PREFERRED EMBODIMENTS

Figures 1, 2, 3:
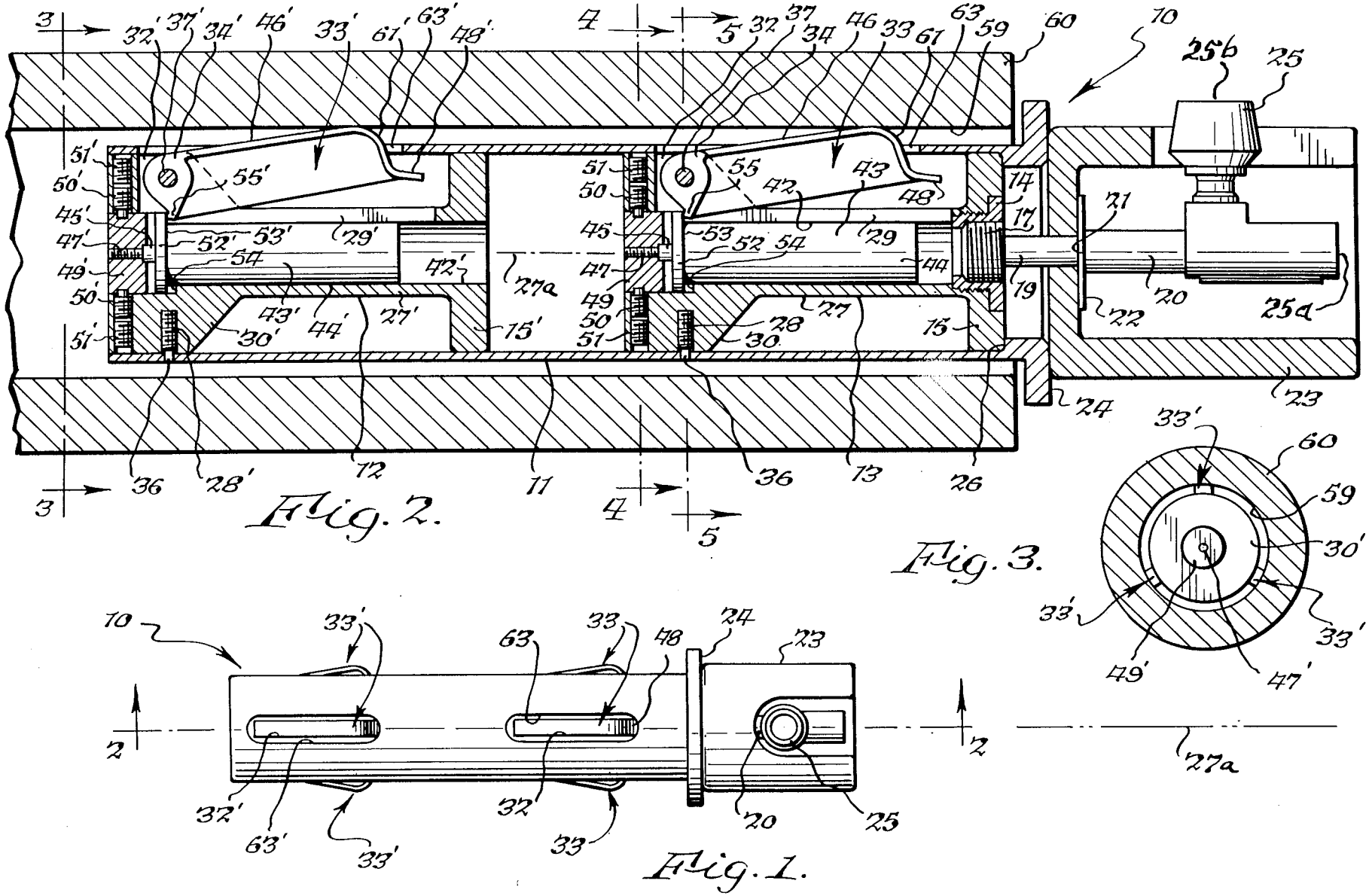
FIG. 1 is a plan view of the improved caliber bar of the present invention.
FIG. 2 is a cross sectional view of the caliber bar taken substantially along line 2—2 of FIG. 1 and showing the caliber bar in the bore at the muzzle end of a gun.
FIG. 3 is a cross sectional view taken substantially along line 3—3 of FIG. 2.

The improved caliber bar 10 includes a frame or outer housing 11 in which trunnion housings or bases 12 and 13 are mounted. Trunnion housings 12 and 13 are identical in all respects except that housing 13 includes a threaded bushing 14 mounted in end wall 15 thereof. The threaded end 17 of rod 19 is screwed into bushing 14. Rod 19 includes an enlarged portion 20 having an annular shoulder 21 which bears against washer 22 so that housing 23 bears against flange 24 of frame 11 when threaded end 17 is screwed into bushing 14. An optical collimator 25, which provides a reticle image (not shown) of the view along the centerline of rod 19, with overlaid grid, usually including cross hairs, is mounted at the end of rod portion 20. Rod 19 is coaxial with the longitudinal centerline 27*a* of frame 11.

As noted above, trunnion housings 12 and 13 are identical except for the above described difference. Therefore unprimed numerals will be used to designate the various parts of housing 13, and primed corresponding numerals will be used to designate corresponding parts of housing 12, thereby obviating the necessity for redundant descriptions.

Figure 5:
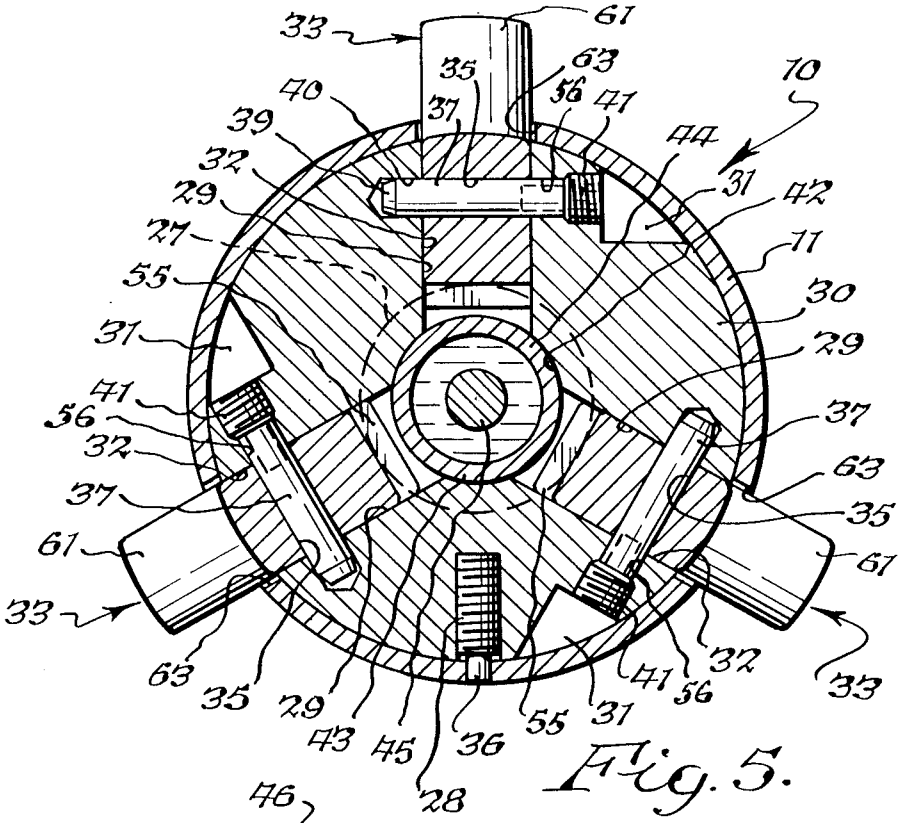
FIG. 5 is a cross sectional view taken substantially along line 5—5 of FIG. 2 and showing the trunnion mountings for the centering arms.
Figure 7:
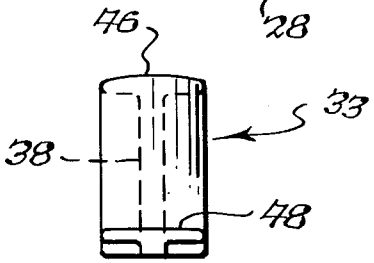
FIG. 7 is an end view of the centering arm taken from the right of FIG. 6.
Figure 4:
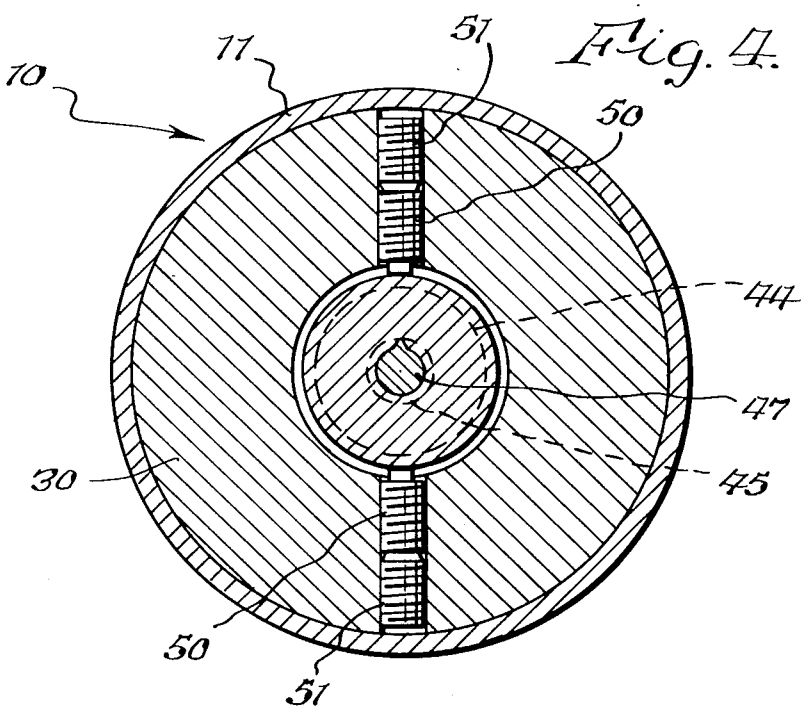
FIG. 4 is a cross sectional view taken substantially along line 4—4 of FIG. 2 and showing the plug mounted in the remainder of the base within the frame.

Trunnion housing 13 includes a central portion 27 having three slots 29 (FIGS. 2 and 5) extending longitudinally thereof and circumferentially spaced 120° from each other. An end plate 15 is located at the end of central portion 27, and as noted above, end plate 15 differs in the above-described manner from end plate 15' of housing 12. A base 30 is located at the opposite end of central portion 27 from end plate 15. Base 30 is of generally circular cross section (FIG. 5) except that it has cutouts 31 therein. Base 30 also includes longitudinally extending slots 32 which are continuations of slots 29.

The outer dimensions of plates 15 and 15' and bases 30 and 30' of trunnion housings 13 and 12 fit within frame 11 with a substantially zero tolerance fit so that housings 12 and 13 can be slid into the position shown in FIG. 2. End plate 15 of housing 13 abuts shoulder 26. Spring detent 28 includes a housing (not numbered) which is screwed into base 30, and it includes a spring biased plunger 36 which is received in a mating aperture in frame 11, thereby removably holding trunnion housing 13 in position.

Figure 6:
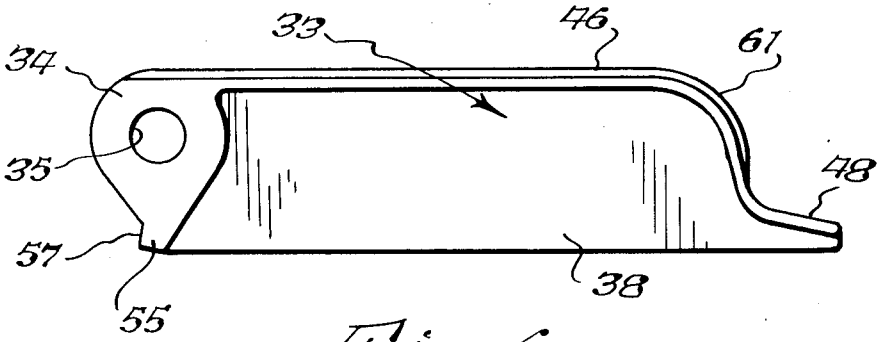
FIG. 6 is a side elevational view of a centering arm.

A plurality of centering arms 33 have first ends 34 having bores 35 therein (FIG. 6) which receive axle pins 37 when the ends of centering arms 33 are mounted in trunnion relationship in slots 32 of base 30. Axle pins 37 have ends 39 which are received in associated bores 40 of base 30, with the central portions of axle pins 37 being received in bores 35 of the centering arms. The opposite ends of axle pins 37 are received in bores 56. Set screws 41 hold axle pins 37 in position. The ends of axle pins 37 proximate set screws 41 are internally threaded to receive threaded puller members (not shown) used to pull pins 37 out of their associated bores. Each of the arms 33 include a longitudinal rib 38 and a broad outer surface 46.

Trunnion housing 13 includes a bore 42 which receives the cylinder 43 of liquid spring 44 in slidable engagement, with the centerline of bore 42 and cylinder 43 being coaxial with centerline **27*a* of frame 11. Piston 45 of liquid spring 44 includes a threaded extension 47 which is threaded into plug 49 which forms a part of base 30. Plug 49 is held in base 30 by set screws 50 which are backed up by additional set screws 51. An annular collar 52 is formed integrally with housing 43 so that it provides an annular shoulder 53 which abuts annular shoulder 54 (FIG. 2) of base 30 to define the limit of movement to the right of cylinder 43. A finger 55 is located at the end of centering arm 33 and it has a surface 57 (FIG. 6) which bears against annular shoulder 53. Thus liquid spring 44 will bias all three fingers 33 outwardly simultaneously equal amounts in a counterclockwise direction in FIG. 2 when collar 52 is not abutting shoulder 54**.

As noted above, the bore 59 at the muzzle end 60 of a gun will be enlarged with use. This enlargement may be a regular or irregular belling out or it may constitute other types of distortions which cause the centerline of the bore to have an alignment which departs from the original centerline. Furthermore, the path of the projectile will follow the centerline of the portion of the muzzle end of the bore which has a length roughly four to five times the nominal diameter of the bore. For example, if the bore is 105 millimeter, the projectile will follow a path which is determined by the longitudinal axis of four to five times 105 millimeter at the muzzle end of the bore.

The improved caliber bar 10 of the present invention allows precise alignment of the optical sight on the gun (not shown) with the centerline of the muzzle end of the barrel, with the projected centerline being visually observed through optical collimator 25. In this respect, the three sets of centering arms 33 will automatically find the center of the portion of the bore where their ends 61 of surfaces 46 contact the adjacent portions of bore 59. The ends 61' of centering arms 33' will also determine the center at the portions of bore 59 which they contact. It will be noted that both sets of arms 33 and 33' contact the muzzle end of the bore at locations spaced axially inwardly from the very end of the muzzle to thus accurately determine the bore centerline, because the very end of the muzzle cannot be used as a reference point for accurately determining the bore centerline. Centering arms 33 extend through slots 63 in frame 11 so that they can move back and forth about the axes of pins 37, as required. The ends 48 of arms 33 will abut the inner surface of frame 11 to further limit the counterclockwise rotation of arms 33 after shoulder 53 abuts shoulder 54.

The geometry of the construction is such that centering arms 33 will be biased simultaneously equal amounts in a counterclockwise direction because of the interengagement between fingers 55 and collar 52. The same is true of centering arms 33' which may be biased outwardly equal amounts which may be different than those of arms 33. The foregoing being the case, the centerlines of cylinders 43 and 43' and the centerline of frame 11 will coincide with the centerline of the portion of muzzle bore 59 which is contacted by the outer curved ends 61 of centering arms 33 and 33'. The collimator 25 is aligned with the centerline of frame 11, and thus will be aligned with the centerline of bore 59. Therefore when the collimator 25 has the target in its cross hairs, the centerline of the bore at the muzzle end of the gun will be in line with the target, and then the sights (not shown) on the gun can also be adjusted to be aligned with the target with any known variance between the bore centerline and the line of fire being taken into account, and thus the gun sights will be properly correlated with the centerline of the bore at the muzzle end of the gun. The contacting ends 61 and 61' of centering arms 33 and 33' are curved (FIG. 5) so as to make substantial point contact with bore 59.

While the collimator 25 is a well known device, by way of broad description, it includes optics which essentially include a prism and lens structure so that when the end **25*a* is pointed at a target, the latter will be visible to a viewer looking down at surface 25*b*, and the target will appear on a suitable grid work or cross hairs at surface 25*b*. When the muzzle 60 has its centerline 27*a*** pointed directly at the target, the latter will be centered directly on the cross hairs.

While the foregoing description has specifically described the present invention in a preferred form utilizing liquid springs, it will be appreciated that other suitable types of springs may be utilized to achieve the broader concepts of the present invention.

While a preferred embodiment of the present invention has been disclosed, it will be appreciated that it is not limited thereto but may be otherwise embodied within the scope of the following claims.

What is claimed is:

1. A caliber bar for alignment with the longitudinal axis of the bore of a gun muzzle comprising a frame having a longitudinal axis for insertion into said bore of said gun muzzle, base means on said frame, a first series of circumferentially spaced first centering arms having inner and outer ends, a second series of circumferentially spaced second centering arms having inner and outer ends, said outer ends of said first series of first arms being axially spaced from said outer ends of said second series of second arms, first and second mounting means mounting said inner ends of said first and second centering arms, respectively, on said base means, spring means mounted relative to said first and second series of centering arms, and first and second interengaging means between said spring means and said inner ends of said first and second centering arms for causing said spring means to bias said outer ends of said first and second series of centering arms independently of each other outwardly away from said longitudinal axis of said frame and into engagement with said bore of said gun muzzle with each of said first centering arms of said first series being biased outwardly first equal amounts and each of said second centering arms of said second series being biased outwardly second equal amounts to thereby align said longitudinal axis of said frame with said longitudinal axis of said bore of said gun muzzle.

2. A caliber bar as set forth in claim 1 wherein each of said first and second series of centering arms comprise three centering arms spaced 120° from each other.

3. A caliber bar as set forth in claim 1 wherein said spring means comprise first and second springs.

4. A caliber bar as set forth in claim 3 wherein said first and second springs comprise first and second fluid springs, respectively, having first and second cylinders, respectively, and first and second pistons, respectively.

5. A caliber bar as set forth in claim 4 including first and second bores in said frame, first and second slidable connections between said first and second cylinders and said first and second bores, respectively, and first and second fixed connections between said first and second pistons and said base means, said first and second interengaging means being located between said inner ends of said first and second centering arms and said first and second cylinders, respectively, to thereby cause the movement of said first and second actuating arms to be correlated with the slidable movement of said first and second cylinders, respectively, in said first and second bores, respectively.

6. A caliber bar as set forth in claim 5 wherein said first and second interengaging means comprise first and second shoulder means on said first and second cylinders, respectively, and first and second fingers on said first and second centering arms, respectively.

7. A caliber bar as set forth in claim 6 including first and second series of slot means in said frame for permitting said outer ends of said first and second series of centering arms, respectively, to project therethrough.

8. A caliber bar as set forth in claim 6 including first and second housings in said frame, and wherein said base means comprise first and second bases on said first and second housings, respectively, and wherein said first and second bores are located in said first and second housings, respectively, third and fourth shoulder means on said first and second housings, respectively, for engagement by said first and second shoulder means, respectively, to limit the amount of slidable movement of said first and second cylinders, respectively, in said first and second bores, respectively.

9. A caliber bar as set forth in claim 8 including first and second series of slot means in said frame for permitting said outer ends of said first and second series of centering arms to project therethrough.

10. A caliber bar as set forth in claim 9 including third and fourth series of slot means in said first and second housings, respectively, for receiving said first and second centering arms, respectively, said third and fourth slot means being in alignment with said first and second series of slot means in said frame, respectively.

11. A caliber bar as set forth in claim 8 including first and second series of slot means in said first and second housings, respectively, for receiving said first and second centering arms, respectively.

12. A caliber bar as set forth in claim 5 wherein said base means comprise first and second bases, and first and second plugs in said first and second bases, respectively, for providing said first and second fixed connections.

13. A caliber bar as set forth in claim 12 including first and second housings in said frame, and wherein said first and second bases are mounted on said first and second housings, respectively, and wherein said first and second plugs are removably secured in said first and second bases, respectively, by first and second set screw means, respectively.

14. A caliber bar as set forth in claim 5 wherein said first and second mounting means comprise first and second trunnions, respectively.

15. A caliber bar as set forth in claim 14 wherein said base means comprise first and second bases, first and second plugs, respectively, on said first and second bases, respectively, for providing said first and second fixed connections.

16. A caliber bar as set forth in claim 15 wherein said first and second plugs are removably secured in said first and second bases, respectively, by first and second set screw means, respectively.

17. A caliber bar as set forth in claim 10 wherein said first and second bases include first and second plugs, respectively, for providing said first and second fixed connections.

18. A caliber bar as set forth in claim 17 wherein said first and second mounting means comprise first and second trunnions, respectively.

19. A caliber bar as set forth in claim 18 wherein said first and second plugs are removably secured in said first and second bases, respectively, by first and second set screw means, respectively.

20. A caliber bar as set forth in claim 19 wherein said first and second bases are parts of first and second housings, respectively, and means for removably mounting said first and second housings in said frame.

* * * * *